US007147422B2

(12) United States Patent
Huotari et al.

(10) Patent No.: US 7,147,422 B2
(45) Date of Patent: Dec. 12, 2006

(54) METHOD AND DEVICE FOR MAKING THE COVERS OF A BOOK OR EQUIVALENT

(75) Inventors: Iisakki Huotari, Helsinki (FI); Jaakko Huotari, Helsinki (FI); Henri Huotari, Espoo (FI); Markku Siikamaki, Espoo (FI); Lauri Huotari, Espoo (FI)

(73) Assignee: Maping KY (FI)

( * ) Notice: Subject to any disclaimer, the term of this patent is extended or adjusted under 35 U.S.C. 154(b) by 375 days.

(21) Appl. No.: 10/276,652

(22) PCT Filed: May 16, 2001

(86) PCT No.: PCT/FI01/00474

§ 371 (c)(1),
(2), (4) Date: May 21, 2003

(87) PCT Pub. No.: WO01/87638

PCT Pub. Date: Nov. 22, 2001

(65) Prior Publication Data

US 2004/0076492 A1 Apr. 22, 2004

(30) Foreign Application Priority Data

May 19, 2000 (FI) ..... 20001205

(51) Int. Cl.
*B42C 11/02* (2006.01)

(52) U.S. Cl. ..... 412/19; 412/4; 412/9; 412/22

(58) Field of Classification Search ..... 412/1, 412/4–6, 8–9, 17, 19, 22, 24, 33, 36–37; 270/58.07, 52.14; 156/443, 580, 908
See application file for complete search history.

(56) References Cited

U.S. PATENT DOCUMENTS

| | | | | |
|---|---|---|---|---|
| 1,703,176 | A * | 2/1929 | Sherman | 412/17 |
| 1,950,550 | A * | 3/1934 | Glass | 156/479 |
| 2,069,885 | A * | 2/1937 | Jeffreys | 156/389 |
| 2,556,787 | A * | 6/1951 | Bach et al. | 156/363 |
| 2,749,967 | A * | 6/1956 | Bach et al. | 156/479 |
| 2,922,172 | A * | 1/1960 | Boyle | 156/516 |
| 3,334,758 | A * | 8/1967 | Depetris et al. | 414/627 |
| 3,405,415 | A * | 10/1968 | Depetris et al. | 412/17 |
| 4,889,461 | A * | 12/1989 | Kampen et al. | 412/19 |
| 5,409,341 | A * | 4/1995 | Rathert | 412/17 |
| 5,413,446 | A | 5/1995 | Rathert et al. | |
| 6,379,094 | B1 * | 4/2002 | Porat | 412/9 |

FOREIGN PATENT DOCUMENTS

WO PCT/GB94/01248 12/1994

* cited by examiner

*Primary Examiner*—Monica Carter
*Assistant Examiner*—Eric A. Gates
(74) *Attorney, Agent, or Firm*—Skinner and Associates

(57) ABSTRACT

A method and a device for making book covers using surface material and cover pieces to be glued onto it. Cover pieces are positioned in the desired location in clamp, that can be rotated around axis, and the pieces are supported by means of stoppers into the desired position. After this, the cover pieces are rotated around axis, while still in the clamp, onto the adhesive surface of surface material sheet, and are pressed onto it.

8 Claims, 3 Drawing Sheets

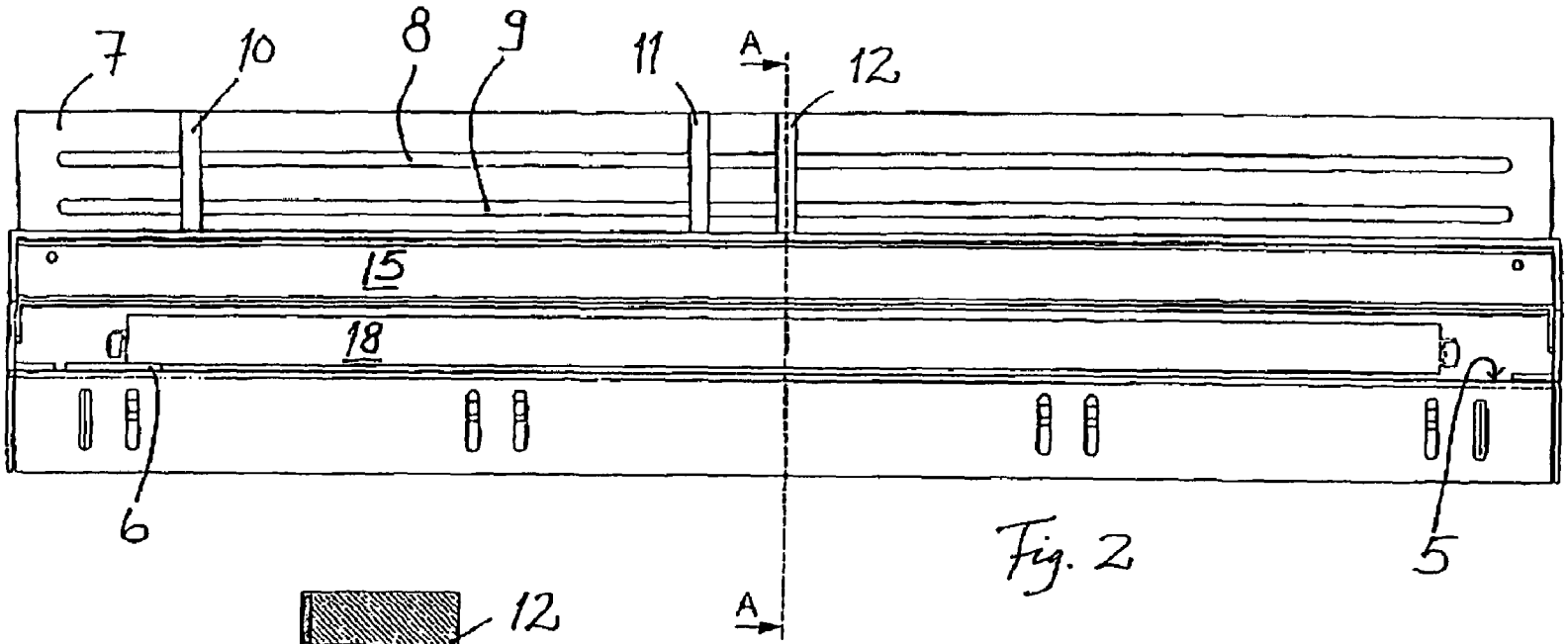
Fig. 2
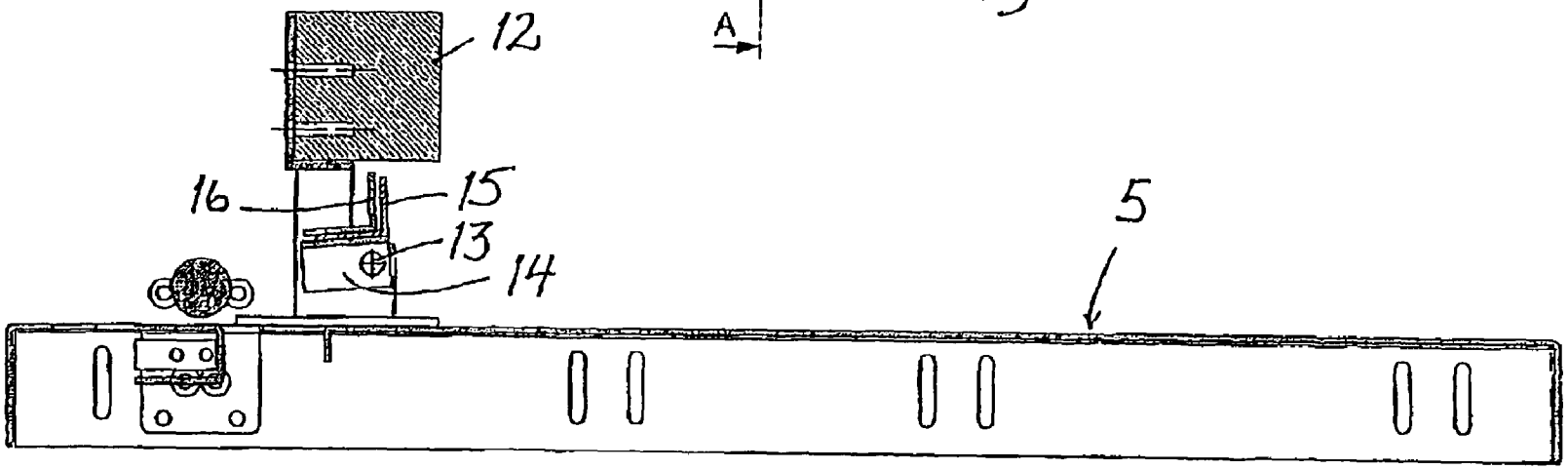
Fig. 3 A-A 1
2
17
19
18

METHOD AND DEVICE FOR MAKING THE COVERS OF A BOOK OR EQUIVALENT

The present invention relates to a method and a device for making the covers of a book or equivalent object. More exactly the invention relates to a method and a device with which one operates with a manual operation gluing cover boards in an accurately defined position on a base material, in order to be used at a later stage to fasten the insides of a book or equivalent between the covers thus produced.

Making book covers by manual work is relatively slow and expensive work, demanding precision. Ordinarily, it is carried out so that an adhesive is spread on a sheet to be used as the surface material of the cover, the sheet is spread on a table surface adhesive-side upwards, the three pieces of board or equivalent forming the cover are placed in position on the adhesive surface and are pressed on to it to ensure being glued, and the parts of the sheet overlapping the board pieces are folded over the edge of the board onto the inner side of the book's cover and are glued onto it. As already mentioned, the work demands precision and care in many respects, because a relatively small inaccuracy in positioning is enough to make the covers useless.

The purpose of this invention is to create a method and a device with which the production of the mentioned type of covers is accomplished faster than traditionally, always accurately, thus avoiding the production of an unusable product and automating the procedures to a certain extent.

The above-mentioned and other positive features and advantages of this invention have been accomplished with a method and a device, the characteristic features of which have been stated in the accompanying Claims.

The invention is described in more detail in the following with reference to the accompanying drawings, in which one embodiment of the invention is presented, without being limited to it in any way.

Figure 1:
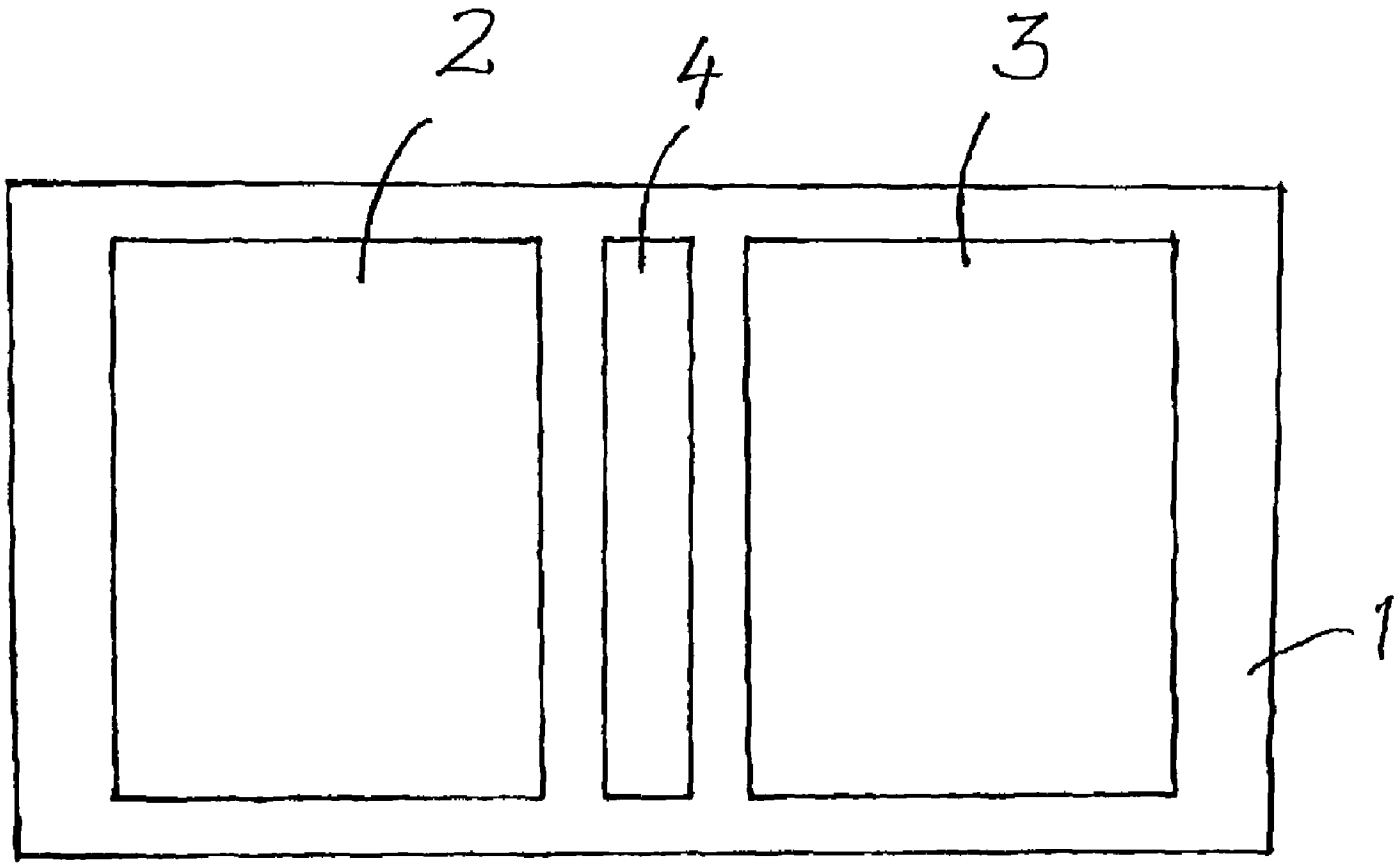

Thus:

FIG. 1 presents the situation in making the covers of a book before the edges of the sheet that forms the surface material are folded;

FIG. 2 presents a device according to the invention as seen directly from the front;

FIG. 3 presents a cross-section A—A of FIG. 2; and

Figure 4:
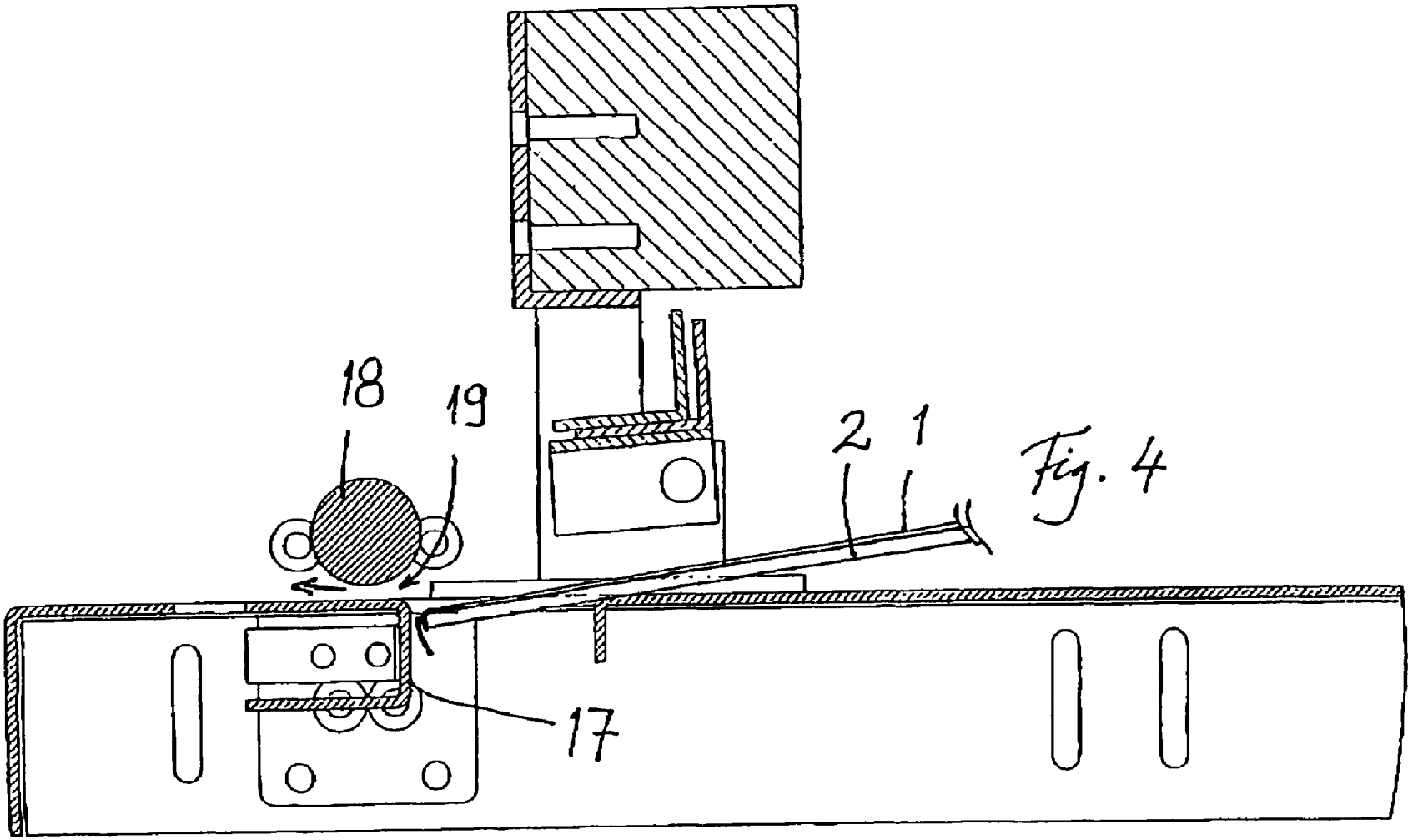

FIG. 4 shows how the surface material is folded onto the inner surface of the cover.

The method will also become clear in connection with the description of the device in FIGS. 2, 3, and 4.

FIG. 1 thus presents the situation aimed at in the initial stage. Thus, sheet 1 forming the surface material of the covers is placed on an even surface and an adhesive is spread on its upper surface or, alternatively, the upper surface is equipped with an adhesive material, in which case a sticker type of material is in question. The pieces 2, 3 and 4 forming the cover, which may be board for example, are placed on the adhesive surface and are pressed onto it. A gap is left between cover pieces 3,4 and 2,4 to ensure that the folding of the covers into a book shape is possible.

According to the state-of-the-art procedure, if the positioning is successful, the process is continued by folding the overlapping parts of sheet 1 over the cover pieces 2, 3 and 4, so that they are glued onto the inner surface of the covers. The folding and gluing is performed manually. This stage is also sensitive to the formation of cockles, in which case the cover is spoilt or at least it does not fulfil the criteria of a high quality product.

FIGS. 2 and 3 present one embodiment of the invention as seen directly from the front in FIG. 2 and as a cross-section along line A—A in FIG. 3. The device is formed of a table top, the surface of which is indicated by reference number 5. The table is especially a horizontal, even surface large enough for the sheet forming the surface material of the book covers to be placed on its top. The sheet's upper surface is an adhesive or the sheet itself is a sticker-type material with the adhesive surface facing upwards. A stopping surface 6 for the sheet is placed on one edge of the table, by means of which the sheet can be placed in position.

Instead of table 5 being made of e.g. metal plate, it can be made by the so-called illuminated table principle, in which case the table can be easily marked with different kinds of markings to assist in placing sheet 1 in its correct position. Alternatively, to facilitate positioning, it is also possible to use a separate light-emitting device which will project the position markings onto the table.

Plate part 7, containing long slots 8, 9 in which are attached stoppers 10, 11, 12 which are movable in the side direction in FIG. 2, is attached to the structure of the device by means of suitable support pieces. Stopper 10 is advantageously fixed to a certain point but stoppers 11 and 12 can be movable. The number of stoppers is in no way limited to three; rather there can be as many as necessary.

Moving the stoppers in the side direction can be arranged in many ways other than using slots. Numerous different ways to move a part easily and conveniently are known from different technical fields, but a more detailed description is omitted here.

Clamp 14, 15, 16, that can be rotated around axis 13, is fastened to the base structure in the area under the stoppers. The purpose is to place the book's cover pieces 2, 3 and 4 formed of cover board or equivalent into the gap formed by the clamp's two gap-adjustable surfaces 15, 16 in such a way that they stay firmly in place. The gap is adjusted according to the material used and especially one of the surfaces 15, 16 is equipped with a surface formed of flexible material, which allows the cover piece to be pushed into the gap using slight force, but however in such a way that the attached piece does not move. It is also clear that the jaws of the clamp can be made to be movable by pneumatic power, an electric motor or equivalent, so that while placing the cover's pieces in position the gap is larger, and after the positioning is completed the cover's parts are fixed in position by diminishing the gap.

The first cover piece is placed against controller 10 and pressed firmly between surfaces 15 and 16. A second controller is moved against the other edge of this cover piece and the next, narrow cover piece is placed against controller 11. Controller 12 is moved against its other surface and the final cover piece is placed in position.

The controllers can also be positioned so that they are fixed for certain dimensions of cover pieces, whereupon the cover pieces are simply placed between the controllers. This obviously applies especially when a series of similar covers is made.

After this clamp 14, 15, 16 is rotated around axis 13, so that the cover pieces, still held in the correct position by clamp 15, 16, are placed against the adhesive surface of the surface material sheet After this, the user presses the cover pieces onto the surface material for some distance at the further end with respect to the clamp, as a result of which the positioning is ensured, and simultaneously pulls the cover pieces with the surface sheet towards himself, so that the other end of the cover pieces is released from the clamp and the pieces are completely glued onto the sheet It is clear that rotation of the clamps may be effected manually but also by the aid of an electric motor or pneumatically or hydraulically when pressurized air or oil is available.

At this stage the cutting of the corners of the surface material can be performed to ensure neat folds. The cutting can also be done before placing the surface material on the table, whereupon this stage is left out as an intermediate work stage.

Now, a method is described by which the parts of the surface material overlapping the cover pieces are neatly and easily folded onto the inner surfaces of the covers. Here, FIG. 4 is referred to. Behind the positioning part described above is a part of the device, which assists the folding of the edges of the surface material against the inner surface of the covers. The mentioned part comprises stopper surface 17 and roll 18. After the cover pieces 2, 3, 4 have been glued onto surface material 1, the whole is picked up by hand and turned over, so that the surface material faces upward. After this, the cover is pushed inside the gap existing under the above-mentioned clamps at a relatively steep angle, so that the edge of the cover goes under stopper surface 17. The edge of the cover is now brought into contact with surface 17 and the edge is slid along surface 17 in firm contact with it. This motion is indicated by the arrows in FIG. 4. The surface material overlapping the edge of the cover is thus beautifully folded first around the edge of the cover, and in the position shown in FIG. 4 it begins to be folded onto the inner surface of the cover.

Roll 18 is placed at such a distance from surface 17 that a gap 19 is formed which is just tightly suitable for cover 2. The roll is especially sprung so that when the cover is pushed into the above-mentioned gap, a small amount of work is needed to overcome the power of the roll's springs in order to open the gap a little larger than it is in its normal position. This ensures that the surface material sticks evenly and well to the cover. The cover can be pulled back through the gap or taken out from the back of the roll. Each side is produced in the same manner. The basic position of roll 18 can be adjusted according to different cover thicknesses.

If desired, surface 17 can be heated, which enables the usage of surface materials affected by temperature. For example, the adhesion may be activated or enhanced by heating.

It is clear that the invention is presented above merely as one embodiment, which is naturally not the only one feasible. Many variations and changes are possible while still remaining within the general inventive principle and the scope of protection of the accompanying Claims. Thus, it is obviously possible to have more than three cover pieces. As an example, such cover structures can be mentioned in which at least the edges of the front and back cover or of both can be folded inward, in which case a semi case structure is formed. Then, there would be at the simplest 4 or 5 cover pieces. More complex case structures can also be constructed applying the method and device according to the invention.

It should be noted that it is possible to use only two cover pieces 2, 3, 4, whereby it is used pieces 2 and 3 which form the actual covers of the book but not cover piece 4 which is usually placed into the construction. The purpose of this kind of construction is to make possible using whatever type of book inner parts, e.g. the type in which the pages of the book have been fixed together with a spiral connector. In this way the spiral connector may change the form of the book's back for instance so that it will become rounded instead of being planar. In fact, making the covers without piece 4 will make it possible to use any kind of binding system and not restricting the same to the spiral system at all. The back of the book will be then softer and it will easily conform to the needed form.

It is self-evident that the cover pieces may, when needed, be formed of material which is different from piece to piece. Especially this is true with piece 4 which may be, when appropriate, of a more flexible of thinner material than the material of pieces 2 and 3. For instance, it may be appropriate to use a cell form layer or another material which is not customary in the art, as material for piece 4.

A device according to the invention in which there is no roll system as described in connection with FIG. 4 is quite practicable, because it is well feasible to fold, around the cover edges, the sides and corners of the sheet to be glued to the cover, only by simply using the table surface as the folding stopper. The attachment of the surface material can be ensured if desired by a separate, possibly heated compactor.

The invention claimed is:

1. A device to make book covers using surface material and a predetermined number of cover pieces that are to be glued onto the surface material, so that the surface material is equipped with an adhesive surface and is on an essentially even surface, characterized in that the device comprises a clamp that can be rotated around an axis and is for the receipt of the cover pieces, the clamp being formed of two plate surfaces, the distance between which can be advantageously adjusted, and stoppers to assist in positioning the cover pieces in a predetermined position, whereupon the intention is to rotate the cover pieces thus positioned in place, still in the clamp, onto the surface of the surface material in order to attach them to it.

2. A device according to claim 1, characterized in that it also includes a stopper surface and a flexibly attached roll near the stopper surface, in which case a gap, corresponding approximately to the thickness of the book cover is left between the stopper surface and the roll.

3. A device according to claim 2, characterized in that the stopper surface and roll are located in the back part of the device, whereupon the pushing of the cover onto the stopper surface and between the stopper surface and the roll is intended to be performed through the gap above a table surface but under the stoppers.

4. A device according to claim 3, characterized in that the table is an illuminated table with markings that ease positioning or that the device includes a separate device which projects markings onto the surface of the table.

5. A device according to claim 1, characterized in that at least one of the plate surfaces is equipped with a flexible covering on the inner surface.

6. A device according to claim 1, characterized in that at least one of the stoppers is fixed in position, while the others can be either fixed or movable in the side direction.

7. A device to make book covers using surface material and a predetermined number of cover pieces that are to be glued onto it, so that a surface material equipped with an adhesive surface is on an essentially even surface, characterized in that it consists of a clamp that can be rotated around axis and is for the receipt of cover pieces, and stoppers to assist in positioning the cover pieces in predetermined positions, whereupon the intention is to rotate the cover pieces thus positioned in place, still in the clamp, onto the surface of the surface material in order to attach them to it, the device further comprising stopper surface and a flexibly attached roll near stopper surface, in which case a gap, corresponding approximately to the thickness of the book cover is left between the stopper surface and the roll, the stopper surface and the roll being located in the back part of the device, whereupon the pushing of the cover onto the stopper surface and between the stopper surface and the roll is intended to be performed through the gap above the table surface but under the part containing the stoppers.

8. A device to make book covers using surface material and a predetermined number of cover pieces that are to be glued onto it, so that a surface material equipped with an adhesive surface is on an essentially even surface, characterized in that it consists of a clamp that can be rotated around axis and is for the receipt of cover pieces, and stoppers to assist in positioning the cover pieces in predetermined positions, whereupon the intention is to rotate the cover pieces thus positioned in place, still in the clamp, onto the surface of the surface material in order to attach them to it, the device further having a table, the table being an illuminated table with markings that ease positioning or the device including a separate device which projects markings onto the surface of the table.

* * * * *